US010988938B2

(12) United States Patent
Wearmouth

(10) Patent No.: US 10,988,938 B2
(45) Date of Patent: Apr. 27, 2021

(54) SELF-LEVELING PLATFORM STAIRS

(71) Applicant: ALLFASTENERS USA, LLC, Sante Fe Springs, CA (US)

(72) Inventor: Shane Joseph Wearmouth, Los Angeles, CA (US)

(73) Assignee: Safesmart LLC, Santa Fe Springs, CA (US)

( * ) Notice: Subject to any disclaimer, the term of this patent is extended or adjusted under 35 U.S.C. 154(b) by 0 days.

(21) Appl. No.: 16/737,519

(22) Filed: Jan. 8, 2020

(65) Prior Publication Data

US 2020/0240149 A1 Jul. 30, 2020

Related U.S. Application Data

(60) Provisional application No. 62/797,488, filed on Jan. 28, 2019.

(51) Int. Cl.

| | |
|---|---|
| ***E04F 11/104*** | (2006.01) |
| ***E04F 11/06*** | (2006.01) |
| ***E04F 11/025*** | (2006.01) |
| ***E04F 11/04*** | (2006.01) |

(52) U.S. Cl.

CPC ..... *E04F 11/1041* (2013.01); *E04F 11/0255* (2013.01); *E04F 11/04* (2013.01); *E04F 11/06* (2013.01)

(58) Field of Classification Search

CPC ... E04F 11/025; E04F 11/1041; E04F 11/112; E04F 11/1817; E04F 11/0255; E04F 11/04; E04F 11/104; E04F 11/06; E04F 11/062; E06C 1/387; E06C 1/22; E06C 1/383; E06C 7/183; E06C 7/42; B62B 1/208

See application file for complete search history.

(56) References Cited

U.S. PATENT DOCUMENTS

| | | | | | |
|---|---|---|---|---|---|
| 1,419,834 | A * | 6/1922 | Fellows | ..... | E04F 11/04 182/1 |
| 2,245,825 | A * | 6/1941 | Ross | ..... | A47C 1/12 52/10 |
| 3,626,438 | A * | 12/1971 | Cornell | ..... | E04F 11/0255 52/183 |

(Continued)

FOREIGN PATENT DOCUMENTS

| | | | | | |
|---|---|---|---|---|---|
| GB | 2432623 | A | 5/2007 | | |
| WO | WO-2010022340 | A1 * | 2/2010 | ..... | E06C 1/39 |
| WO | 2010084135 | A1 | 7/2010 | | |

*Primary Examiner* — Jessie T Fonseca

(74) *Attorney, Agent, or Firm* — Luedeka Neely Group, PC

(57) ABSTRACT

A self-leveling staircase. The staircase has a first flight of self-leveling steps having a first end adjacent to the ground and a plurality of stair treads pivotally attached at a right edge to a first pair or stair rails and at a left edge to a second pair of stair rails. A self-leveling platform is pivotally attached on a second end of the first flight of self-leveling steps and to the first and second pair of stair rails. A second flight of self-leveling steps having a first end is pivotally attached to an opposite side of the self-leveling platform from the first flight of self-leveling steps. The second flight of self-leveling step has a plurality of stair treads pivotally attached at a right edge to a third pair of stair rails and pivotally attached at a left edge on front and back ends thereof to a fourth pair of stair rails.

10 Claims, 7 Drawing Sheets

(56) References Cited

U.S. PATENT DOCUMENTS 3,693,754 A * 9/1972 Butler ..... E04F 11/062 182/86
3,713,511 A * 1/1973 Hinkle ..... E06C 9/06 182/95
3,765,137 A * 10/1973 Loix ..... E04F 11/0255 52/182
4,100,995 A 7/1978 Pradon
4,168,764 A * 9/1979 Walters ..... B63B 27/14 182/1
4,768,617 A * 9/1988 Mason ..... B64F 1/315 182/1
4,959,935 A * 10/1990 Stob ..... E01D 15/24 182/156
5,189,854 A * 3/1993 Nebel ..... B63B 27/14 182/1
5,555,953 A 9/1996 Henderson
6,189,653 B1 2/2001 Laug
6,206,139 B1 * 3/2001 Bogart, Jr. ..... E06C 1/22 182/166
6,951,265 B2 10/2005 Frame et al.
7,140,467 B2 11/2006 Cook
7,448,470 B2 11/2008 Brown et al.
8,235,126 B2 8/2012 Bradley
2008/0163571 A1 * 7/2008 Kohler ..... E04F 11/002 52/183
2009/0301813 A1 12/2009 Chantelois et al.
2011/0139544 A1 * 6/2011 Frick ..... E04F 11/062 182/27
2012/0204502 A1 * 8/2012 Gardner ..... E04F 11/163 52/179
2013/0292205 A1 * 11/2013 Frick ..... E06C 1/383 182/156
2014/0345974 A1 * 11/2014 Nebel ..... E06C 5/02 182/159
2017/0292349 A1 10/2017 Toma et al.
2019/0351832 A1 * 11/2019 Fuller ..... E06C 5/44
2020/0102788 A1 * 4/2020 Byers ..... E06C 7/505
2020/0247322 A1 * 8/2020 Honer ..... B60R 3/02

* cited by examiner

SELF-LEVELING PLATFORM STAIRS

RELATED APPLICATION

This application claims priority to provisional application Ser. No. 62/797,488, filed Jan. 28, 2019, now pending.

TECHNICAL FIELD

The disclosure is directed to self-leveling stairs and in particular to light-weight self-leveling stairs having an intermediate platform.

BACKGROUND AND SUMMARY

Portable stairs are used for a variety of applications in construction, home building stores, unloading platforms and the like. Most portable stairs are designed for a particular application and are not readily usable for alternate locations. For example, a construction site might require stairs that reach a particular height. Another location of the same job site might require stairs of a different height. Also, many of the portable stairs now available are difficult to transport from one location to another. What is needed is a light-weight portable staircase that can be used for a variety of heights.

While an adjustable height staircase is of primary concern, there is also a need for an adjustable height staircase that can be used as a platform or ramp. A prior art self-adjusting staircase 10 and step therefor is illustrated in FIGS. 1-4. The self-adjusting staircase has a plurality of treads 12 pivotally attached on each end thereof to a pair of upper and lower side rails 14A and 14B. The pivotal feet 16A and 16B are attached to terminal ends of the side rails 14A and 14B to move the side rails 14A and 14B and trads 12 attached to the side rails so that the treads 12 remain parallel to the ground. As shown in FIGS. 2 and 3, even when the pair of upper and lower side rails 14A and 14B are adjacent to one another, the treads 12 are slightly raised on one end and thus do not provide a smooth ramp. Each tread 12 as shown in FIG. 4 contains a planar top surface 18 and a pair of holes 20 on each end that lie in a plane parallel with the top surface 18. Accordingly, since one of the pair of side rails 14A or 14B lies above the other side rail to which one end of the tread 12 is pivotally attached, the tread 12 will remain at an angle regardless of how close each side rail is to the other side rail in the pair of side rails 14A or 14B. As the angle of the stairs is increased, each side rail of the pair of side rails 14A or 14B moves further from the other side rail in order to keep each tread 12 parallel to the ground. Accordingly, there is a need for an improved self-leveling staircase that is lightweight, versatile and provides improved safety features.

In view of the foregoing an embodiment of the disclosure provides a self-leveling staircase. The self-leveling staircase includes a first flight of self-leveling steps having a first end adjacent to the ground and a plurality of stair treads pivotally attached on a right side on front and back ends thereof to a first pair or stair rails and pivotally attached on a left side on front and back ends thereof to a second pair of stair rails. A self-leveling platform is pivotally attached on a second end of the first flight of self-leveling steps and to the first and second pair of stair rails. A second flight of self-leveling steps has a first end pivotally attached to an opposite side of the self-leveling platform from the first flight of self-leveling steps. The second flight of self-leveling steps includes a plurality of stair treads pivotally attached on a right side on front and back ends thereof to a third pair of stair rails and pivotally attached on a left side on front and back ends thereof to a fourth pair of stair rails. An adjustable support is pivotally attached to opposing sides of the platform for contacting the ground.

In some embodiments, the self-leveling staircase includes a first foot pivotally attached to a first end of the first pair of stair rails and a second foot pivotally attached to a first end of the second pair of stair rails, wherein the foot is adjacent to the ground.

In other embodiments, each of the first and second flight of self-leveling steps is collapsible into a planar ramp shape.

In still other embodiments, removable handrails are provided for the self-leveling staircase.

In another embodiment, each stair tread has first pivot arm for a first pivot rod attached to a front stair rail and a second pivot arm for a second pivot rod attached to a rear stair rail of each pair of first and second stair rails. The front stair rail defines a first plane and the second stair rail defines a second plane parallel to the first plane. The first pivot rod is attached to the first pivot arm in the first plane and the second pivot rod is attached to the second pivot arm in the second plane that is offset from the first plane so that a tread surface of the stair tread is substantially parallel with the first and second planes.

In some embodiments, the first and second pair of stair rails, the platform and the stair treads are made of an aluminum material. In other embodiments, the first and second pair of stair rails, the platform and the stair treads are made of a fiberglass material.

In still other embodiments, there is provided a stair tread for a self-leveling staircase having a front stair rail and a rear stair rail on each side of the stair tread. The stair tread includes a tread surface and a first pivot arm disposed opposite the tread surface for pivotally attaching the stair tread to the front stair rail and a second pivot arm disposed opposite the tread surface for pivotally attaching the stair tread to the rear stair rail. The front stair rail defines a first plane and the second stair rail defines a second plane parallel to the first plane. The first pivot arm is pivotally attached to the first stair rail in the first plane and the second pivot arm is pivotally attached to the to the second stair rail in the second plane offset from the first plane so that the tread surface of the stair tread is substantially parallel with the first and second planes.

An advantage of the embodiments of the disclosure is that it provides improved safety with an ability to extend the staircase a much greater distance that possible with staircases devoid of an intermediate platform. The unique design of the stair tread also enables the staircase to be use as a ramp over uneven ground or for slight inclines.

BRIEF DESCRIPTION OF THE DRAWINGS

Other features and advantages of the disclosed embodiments may be evident by reference to the attached drawings in combination with the following disclosure, wherein.

DETAILED DESCRIPTION

Figure 1:
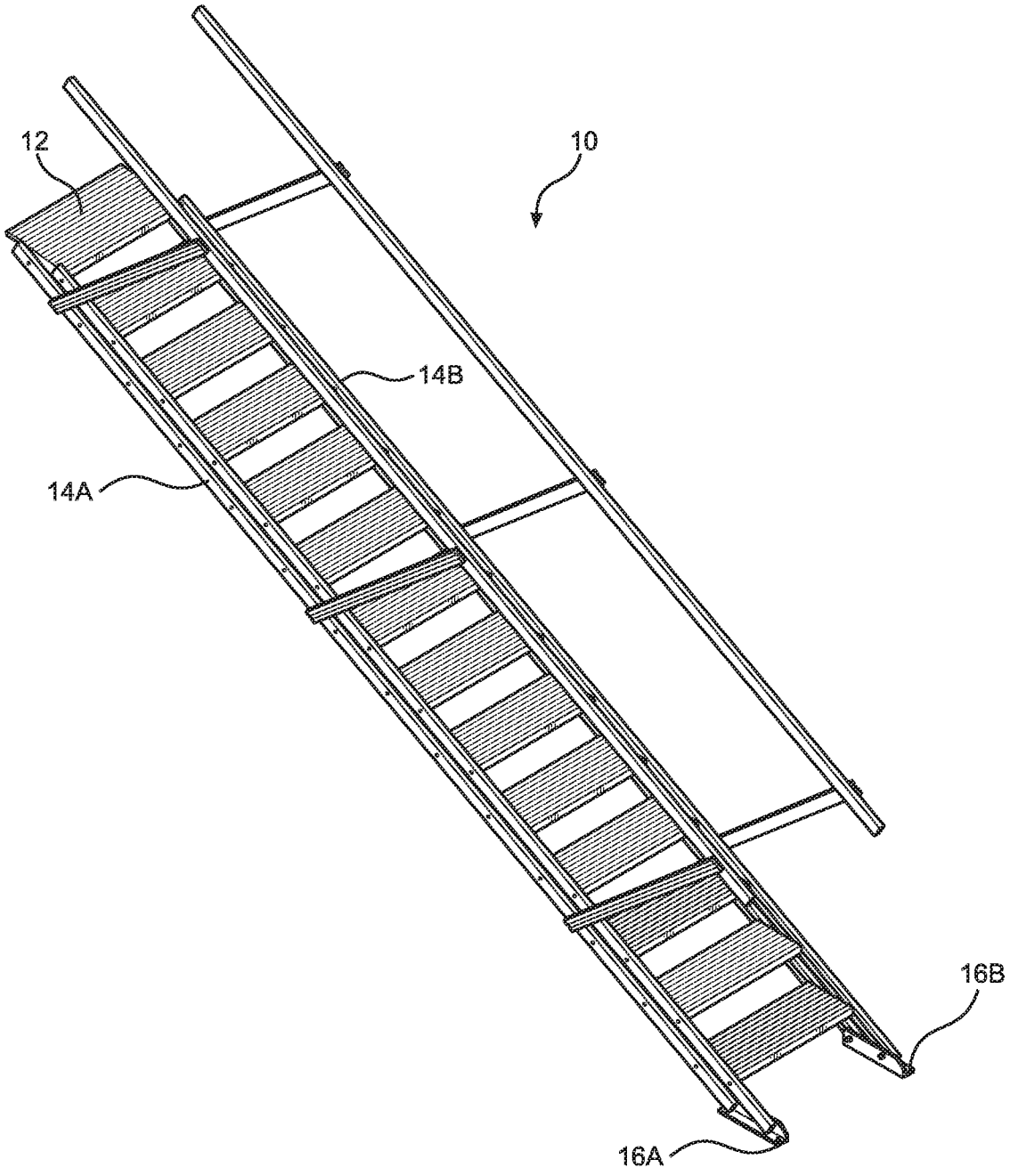
FIG. 1 Prior Art
FIG. 1 is a perspective view of a prior art staircase.
Figure 2:
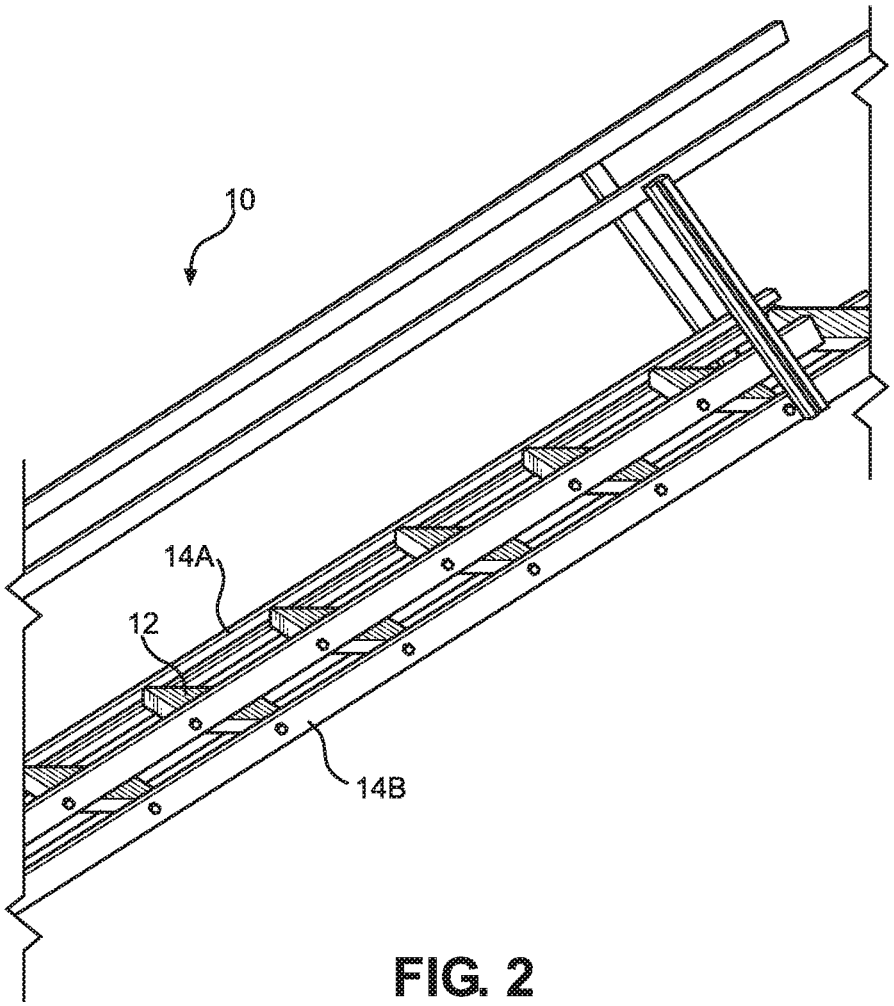
FIG. 2 Prior Art
FIG. 2 is a side elevational view, of a portion of the prior art staircase of FIG. 1 in a use position.
Figure 3:
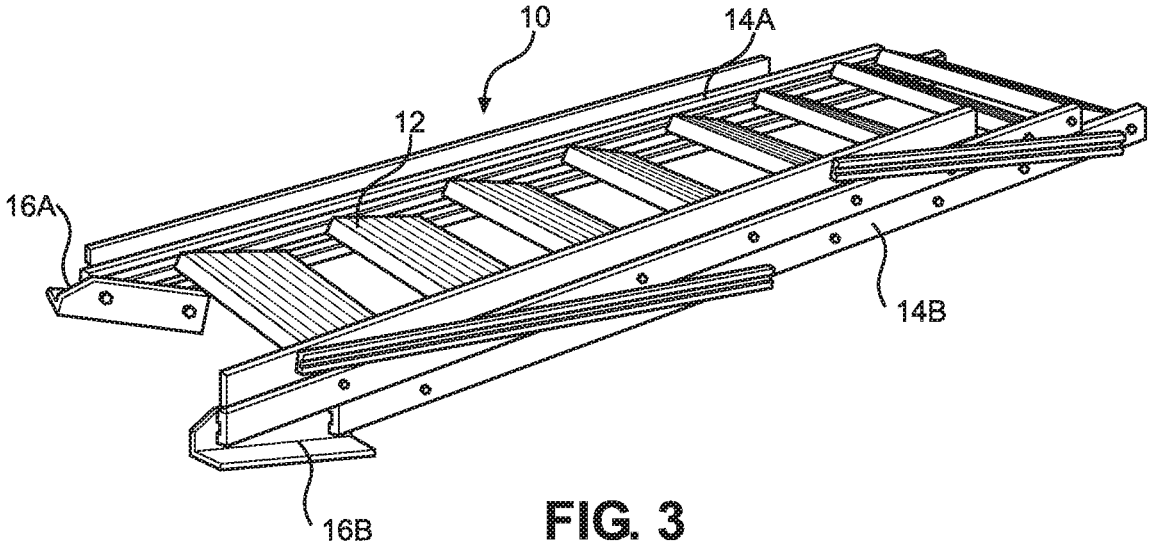
FIG. 3 Prior Art
FIG. 3 is a perspective view of the prior art staircase of FIG. 1 in a collapsed position.
Figure 4:
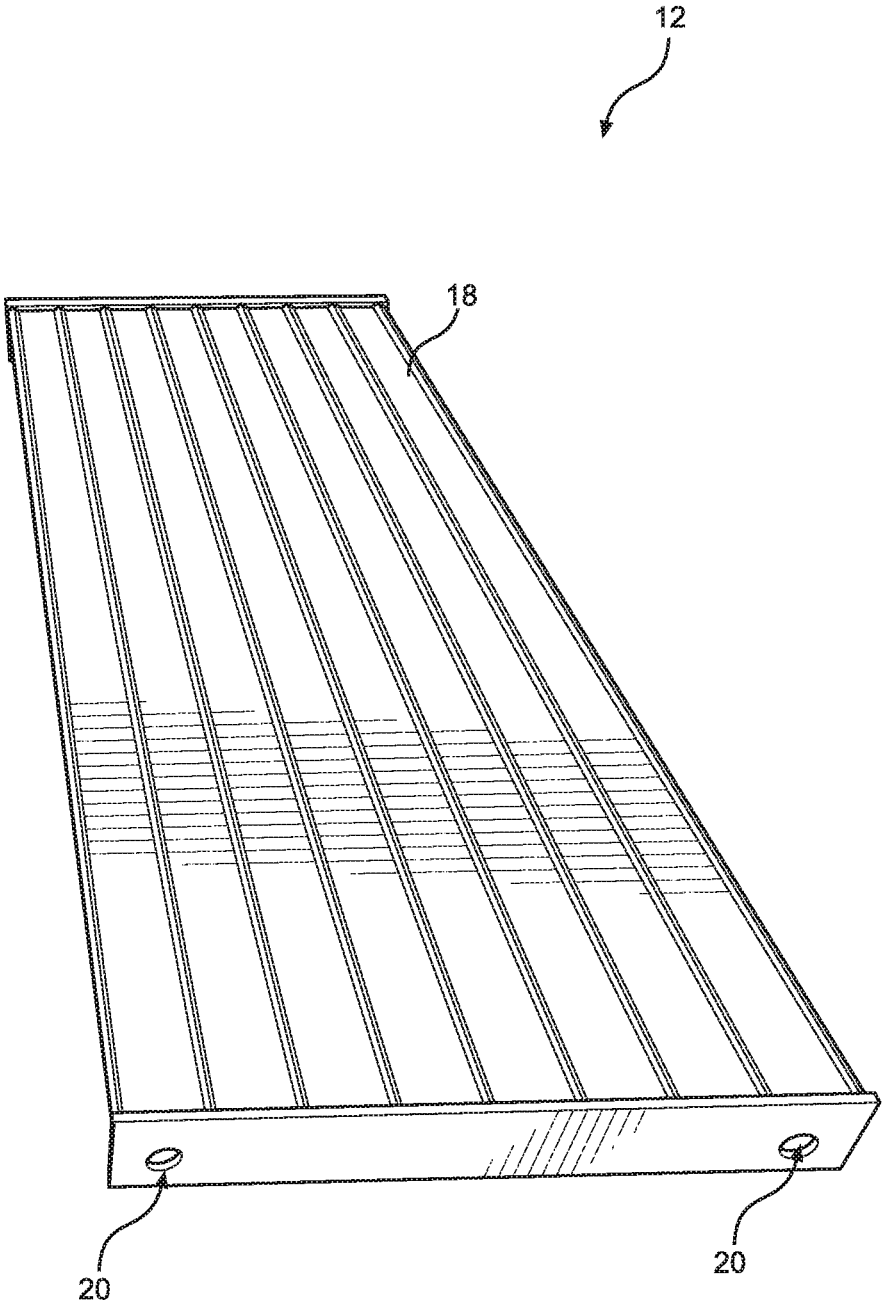
FIG. 4 Prior Art
FIG. 4 is a perspective view of a stair tread for the prior art staircase of FIG. 1.
Figure 5:
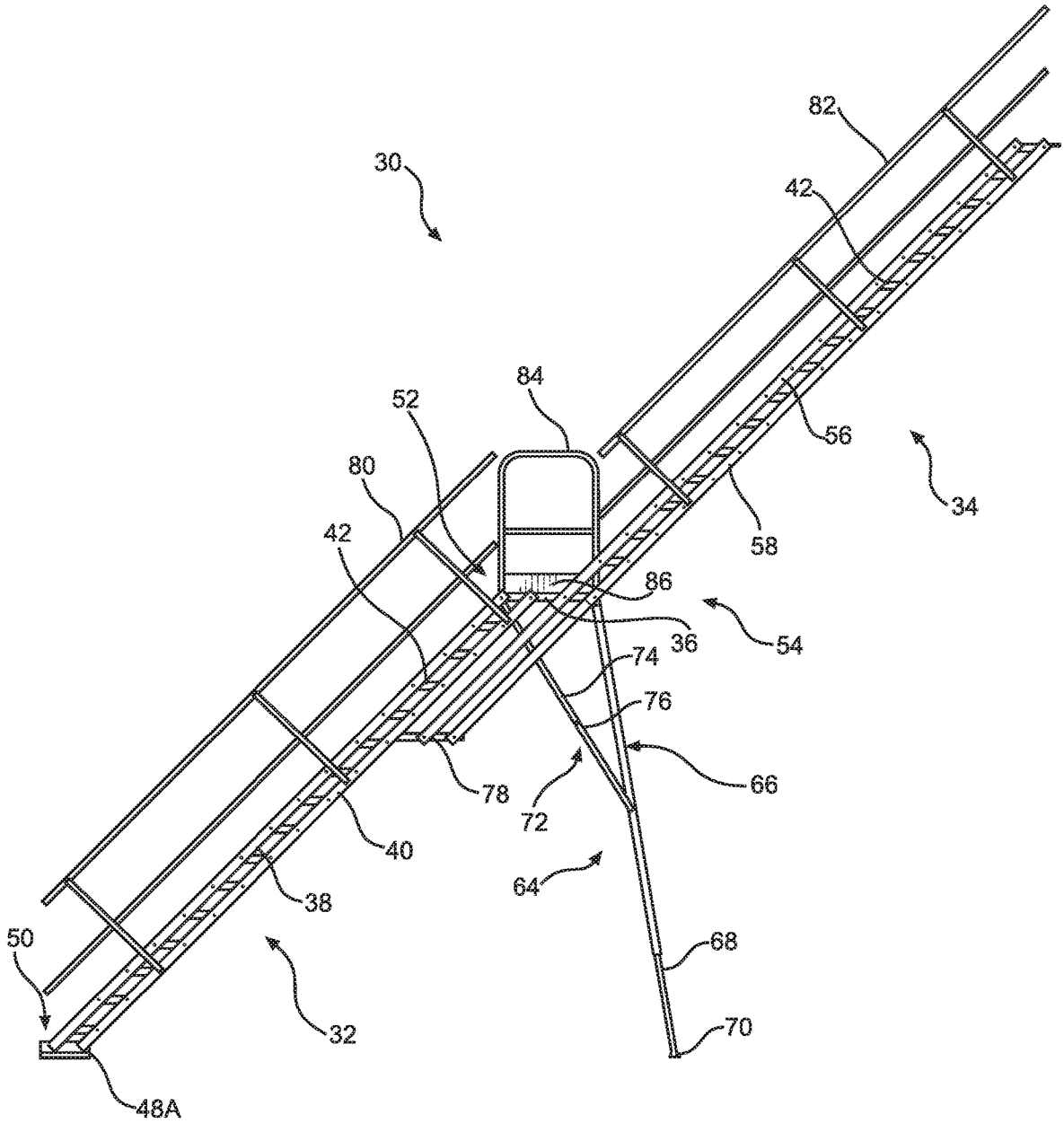
FIG. 5 is side elevational view of a self-leveling staircase in a use position according to the disclosure.
Figure 6:
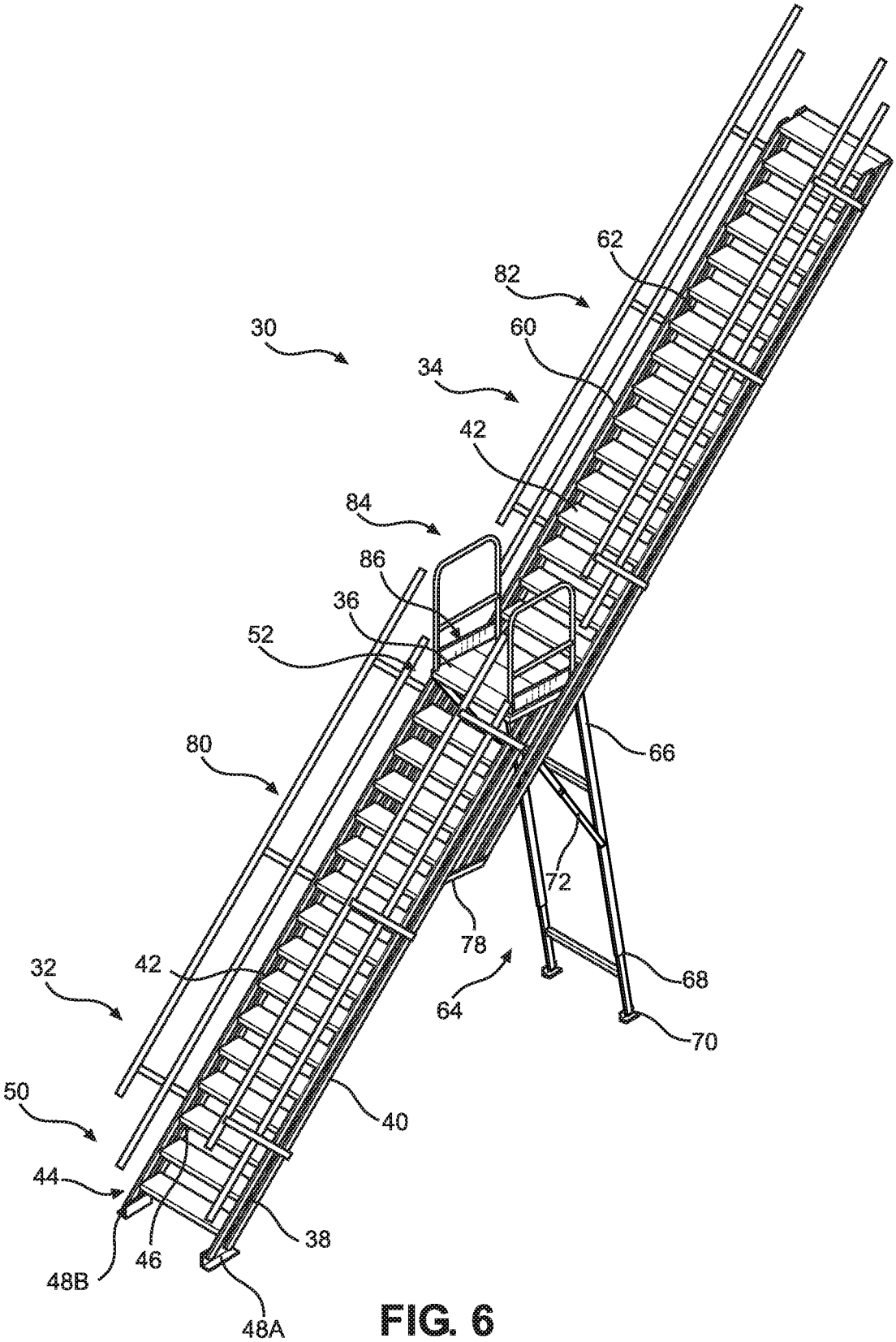
FIG. 6 is a perspective view of the self-leveling staircase of FIG. 5 in the use position.
Figure 7:
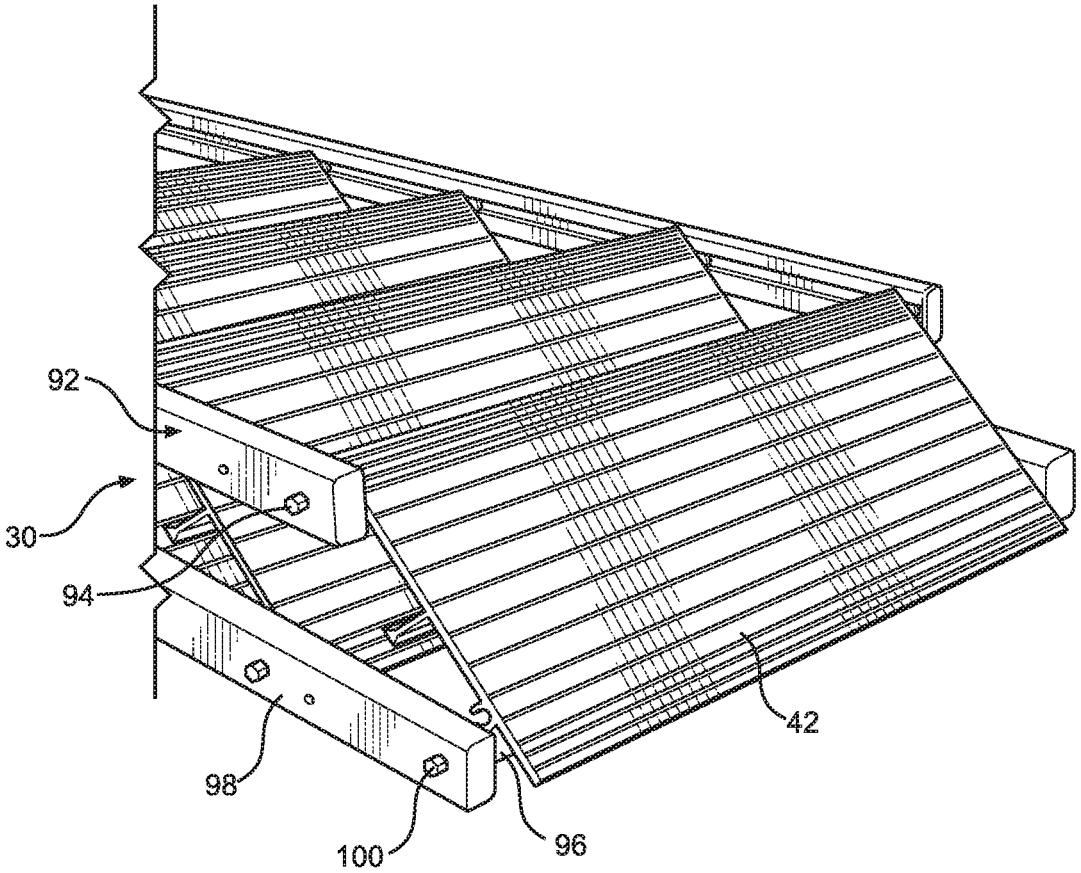
FIG. 7 is a partial perspective view of a portion of the self-leveling staircase of FIG. 5 being moved to a fully closed position.

An elevational view of the self-leveling staircase 30 having two flight of self-leveling steps 32 and 34 and a self-leveling platform 36 between the two flights of steps 32 and 34 is shown in FIGS. 5-7. The first flight of steps 32 extends upwardly to the platform 36. The first flight of steps 32 has a first pair of stair rails 38 and 40 pivotally attached on a right edge to the plurality of stair treads 42 and a second pair of stair rails 44 and 46 pivotally attached on a left edge to the plurality of stair treads 22 (FIG. 6). A first end of the first flight of steps 32 may include a foot 48A pivotally attached to the first pair of stair rails 38 and 40 and a foot 48B pivotally attached to the second pair of stair rails 44 and 46. Each foot 48A and 48B is on a first end 50 of the self-leveling steps 32.

The self-leveling platform 36 is pivotally attached on a second end 52 of the first flight of steps 32 to the first pair of rails 38 and 40 and to second pair of rails 44 and 46. The second flight of steps 34 extends upwardly from the platform 36. The second flight of steps 34 is attached on a first end 54 thereof to an opposite side of the self-leveling platform 36 to which the first flight of steps 32 is attached. A user can climb the two flights 32 and 34 and the self-leveling platform 36 in a straight path without turning left or right. Preferably the flights of steps lie in parallel planes and have the same climb angle. The self-leveling platform 36 gives the user a relatively wide area to rest between flights 32 and 34.

Like the first flight of self-leveling steps 32, the second flight of self-leveling steps 34 includes a plurality of stair treads 42 pivotally attached at a right edge on opposing sides thereof to a third pair of stair rails 56 and 58 and pivotally attached on a left edge on opposing sides thereof to a fourth pair of stair rails 60 and 62. An adjustable support 64 is pivotally attached to opposing sides of the platform 36 for contacting the ground. The adjustable support 64 may include an upper leg 66 and a lower leg 68 that can be slidably adjusted with respect to the upper leg 66. A foot 70 is disposed on the end of the lower leg 68 for contact with the ground. The adjustable support 64 also includes an adjustable brace 72 pivotally attached to the upper leg 66 and to the platform 36 and containing an upper brace 74 and a lower brace 76 that is slidably adjustable with the upper brace 74.

Since the second flight of steps 34 does not contact the ground, the third set of rails 56 and 58 and the fourth set of rails 60 and 62 may be extended past the platform 36 and pivotally attached to the first flight of steps 32 by a brace 78. The brace 78 is attached to the first set of rails 38 and 40 and to the second set of rails 44 and 46 so that it is parallel with the treads 42 of the first and second flight of steps.

The first flight of steps 32 may include a handrail 80 that may be removably or fixedly attached to the first flight of steps 32. Likewise, the second flight of steps 34 may include a handrail 82 that may be removably or fixedly attached to the second flight of steps 34. A handrail 84 may be removably or fixedly attached to the platform 16. A kickplate 86 may be attached to the handrail 84 of the platform 36.

The entire self-leveling staircase 30, other than fastener and joints, is made of light construction, such as aluminum or fiberglass, so that it can be easily moved on a construction site much like a long ladder.

Figure 8:
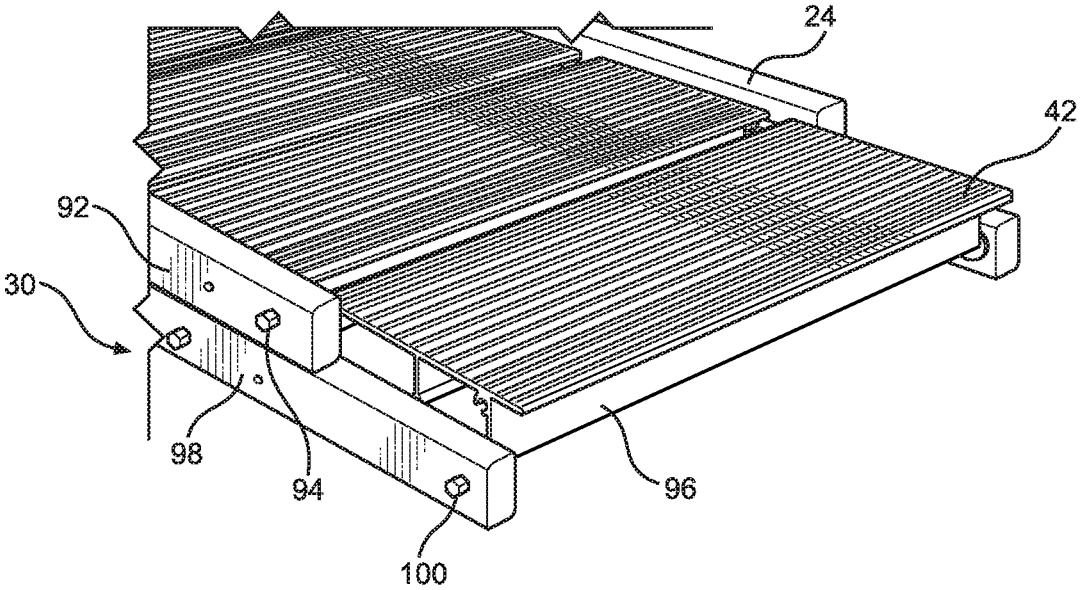
FIG. 8 is a partial perspective view of a portion of the self-leveling staircase of FIG. 5 in the fully closed position.
Figure 9:
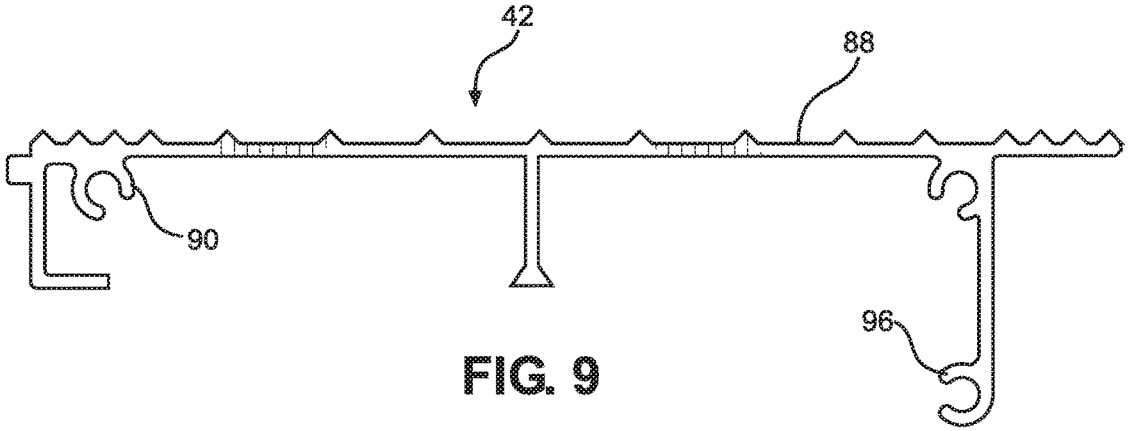
FIG. 9 is a side elevational view, not to scale, of a stair tread for the self-leveling staircase of FIG. 5.
Figure 10:
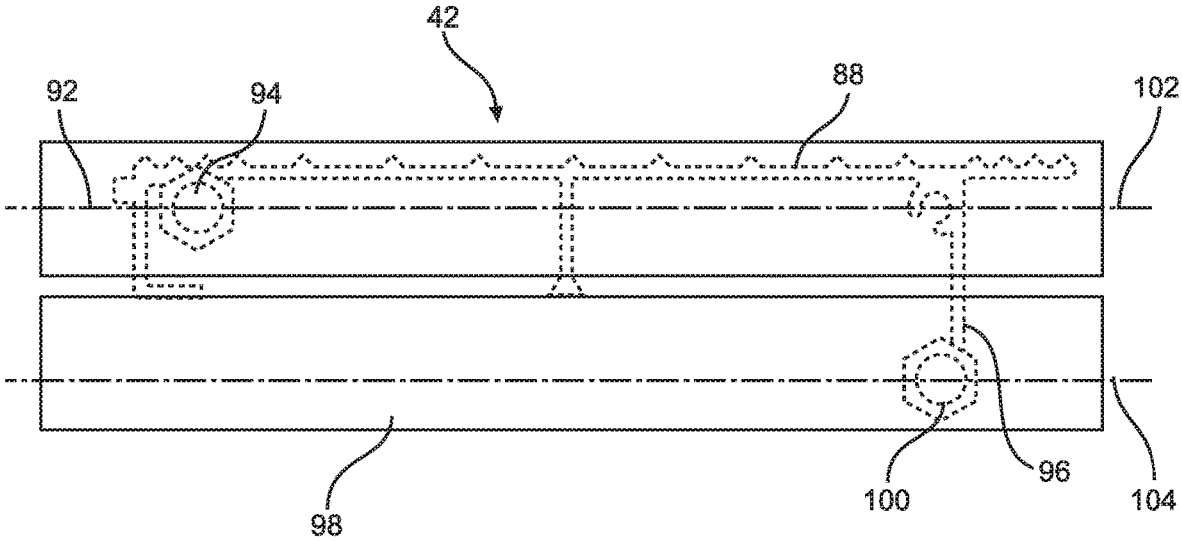
FIG. 10 is a side elevational view not to scale of a stair tread and portion of the side rails for the self-leveling staircase of FIG. 5.

As shown in FIGS. 7 and 8, the self-leveling staircase 30 also has a lay-flat position when not in use as stairs so that it can be used as a platform or ramp. The lay-flat position is achieved by use of a redesigned stair tread 42 as shown in FIGS. 9 and 10. The stair tread has a tread surface 88 and a first pivot arm 90 disposed opposite the tread surface for pivotally attaching the stair tread 42 to a front stair rail 92 by means of a bolt 94 and a second pivot arm 96 disposed opposite the tread surface 88 for pivotally attaching the stair tread 42 to a rear stair rail 98 by means of a bolt 100. The front stair rail 92 defines a first plane 102 and the second stair rail 98 defines a second plane 104 parallel to the first plane 102. The first pivot arm 90 is pivotally attached to the first stair rail 92 in the first plane 102 and the second pivot arm 96 is pivotally attached to the to the second stair rail 98 in the second plane 104 offset from the first plane 102 so that the tread surface 88 of the stair tread 42 is substantially parallel with the first plane 102 and second plane 104 as shown in FIGS. 8 and 10.

The foregoing description of preferred embodiments have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A self-leveling staircase comprising:

a first flight of self-leveling steps having a first end adjacent to the ground and comprising a plurality of stair treads pivotally attached on a right side on front and back ends thereof to a first pair of stair rails and pivotally attached on a left side on front and back ends thereof to a second pair of stair rails;

a self-leveling platform pivotally attached on a second end of the first flight of self-leveling steps and to the first and second pair of stair rails;

a second flight of self-leveling steps having a first end pivotally attached to an opposite side of the self-leveling platform from the first flight of self-leveling steps, the second flight of self-leveling step comprising a plurality of stair treads pivotally attached on a right side on front and back ends thereof to a third pair of stair rails and pivotally attached on a left side on front and back ends thereof to a fourth pair of stair rails; and an adjustable support pivotally attached to opposing sides of the platform for contacting the ground.

2. The self-leveling staircase of claim 1, further comprising a first foot pivotally attached to a first end of the first pair of stair rails and a second foot pivotally attached to a first end of the second pair of stair rails, wherein the first foot and the second foot are adjacent to the ground.

3. The self-leveling staircase of claim 1, wherein each of the first and second flight of self-leveling steps is collapsible into a planar ramp shape.

4. The self-leveling staircase of claim 1, further comprising removable handrails.

5. The self-leveling staircase of claim 1, wherein each stair tread of the first flight and each stair tread of the second flight of self-leveling steps has a first pivot arm for a first pivot rod attached to a front stair rail and a second pivot arm for a second pivot rod attached to a rear stair rail of each pair of first and second stair rails and each pair of third and fourth stair rails, wherein the front stair rail defines a first plane and the rear stair rail defines a second plane parallel to the first plane, and wherein the first pivot rod is attached to the first pivot arm in the first plane and the second pivot rod is attached to the second pivot arm in the second plane offset from the first plane so that a tread surface of the stair tread is substantially parallel with the first and second planes.

6. The self-leveling staircase of claim 1, wherein the first, second, third and fourth pair of stair rails, the platform and the stair treads comprise an aluminum material.

7. The self-leveling staircase of claim 1, wherein the first, second, third and fourth pair of stair rails, the platform and the stair treads comprise a fiberglass material.

8. A stair tread having a first end and second end for a self-leveling staircase, the staircase having a front stair rail and a rear stair rail disposed at each of the first end and the second end of the stair tread, the stair tread comprising a tread surface and a first pivot arm disposed opposite the tread surface in a first direction for pivotally attaching the stair tread to the front stair rail and a second pivot arm disposed opposite the tread surface in a first direction for pivotally attaching the stair tread to the rear stair rail, wherein the front stair rail defines a first plane and the second stair rail defines a second plane offset and parallel to the first plane, and wherein the first pivot arm and the second pivot arm are arranged so the first pivot arm is pivotally attached to the front stair rail in the first plane and the second pivot arm is pivotally attached to the to the rear stair rail in the second plane offset from the first plane so that the tread surface of the stair tread is substantially parallel with the first and second planes.

9. A self-leveling staircase comprising a plurality of stair treads attached to the front stair rail and the rear stair rail on each of the first end and the second end of each stair tread according to claim 8.

10. The self-leveling staircase of claim 9, further comprising a self-leveling platform.

* * * * *